United States Patent [19]

Toledo

[11] Patent Number: 5,024,070

[45] Date of Patent: Jun. 18, 1991

[54] LOCK MOUNTING PAD

[75] Inventor: George F. Toledo, Fall Brook, Calif.

[73] Assignee: Thomas Industries, Inc., Los Angeles, Calif.

[21] Appl. No.: 490,443

[22] Filed: Mar. 8, 1990

[51] Int. Cl.[5] ..... E05B 9/08

[52] U.S. Cl. ..... 70/370; 49/141; 49/503; 70/92; 70/451; 292/21; 292/DIG. 53

[58] Field of Search ..... 70/232, DIG. 57, 370, 70/451, 466, 92; 292/DIG. 53, DIG. 64, 21, 92; 49/141, 503

[56] References Cited

U.S. PATENT DOCUMENTS

| | | | |
|---|---|---|---|
| 1,399,159 | 12/1921 | Segal | 70/370 |
| 1,561,771 | 11/1925 | Best | 70/370 |
| 1,684,230 | 9/1928 | Lach | 70/370 |
| 1,777,725 | 10/1930 | Hines | 70/370 |
| 2,724,958 | 11/1955 | Psik | 70/451 |
| 2,869,353 | 1/1959 | Imhoff, Jr. | 70/370 |
| 2,919,571 | 1/1960 | Welch . | |
| 3,334,500 | 8/1967 | Bejarano . | |
| 3,659,445 | 5/1972 | Eads et al. | 70/451 |
| 3,745,795 | 7/1973 | Sanders | 70/451 |
| 3,940,886 | 3/1976 | Ellingson, Jr. | 49/319 |
| 3,993,335 | 11/1976 | Schmidt | 292/21 |
| 4,083,590 | 4/1978 | Folger | 292/92 |
| 4,130,306 | 12/1978 | Brkic | 292/5 |
| 4,225,163 | 9/1980 | Hubbard et al. | 292/21 |
| 4,570,471 | 2/1986 | Crepinsek | 70/451 |
| 4,576,023 | 3/1986 | Crepinsek | 70/137 |
| 4,813,250 | 3/1989 | Yeh | 70/DIG. 57 X |
| 4,839,988 | 6/1989 | Betts et al. | 292/21 X |

FOREIGN PATENT DOCUMENTS

| | | | |
|---|---|---|---|
| 243854 | 3/1963 | Australia | 70/370 |
| 521589 | 3/1931 | Fed. Rep. of Germany | 70/370 |
| 606720 | 12/1934 | Fed. Rep. of Germany | 70/451 |
| 1414273 | 11/1975 | United Kingdom | 70/451 |

*Primary Examiner*—Lloyd A. Gall

*Attorney, Agent, or Firm*—Hill, Van Santen, Steadman & Simpson

[57] ABSTRACT

A mounting pad for a lock cylinder provides a plurality of bosses which protrude interior of a door stile, the bosses having inclined threaded bores which hold set screws, the set screws are accessed laterally through an access opening on the side wall of the stile, the set screws are progressed outwardly of the bosses to press against an inside wall of the stile, thus clamping the mounting pad to the door stile. The mounting pad holds a lock cylinder inside an annular lock collar by use of a lock ring. The lock cylinder communicates to mechanical means residing interior of the door stile to effectuate latching of the door with a key. The access opening for insertion of a tool such as an Allan wrench to progress the set screws is located on an interior side wall of the door stile such that when the door is completely assembled, the access opening is covered either by an interior door panel, or other door structures such as a panic exit device or panic bar. The invention provides an attachment for a lock cylinder which makes the fasteners non-visible and inaccessible to tampering.

23 Claims, 2 Drawing Sheets

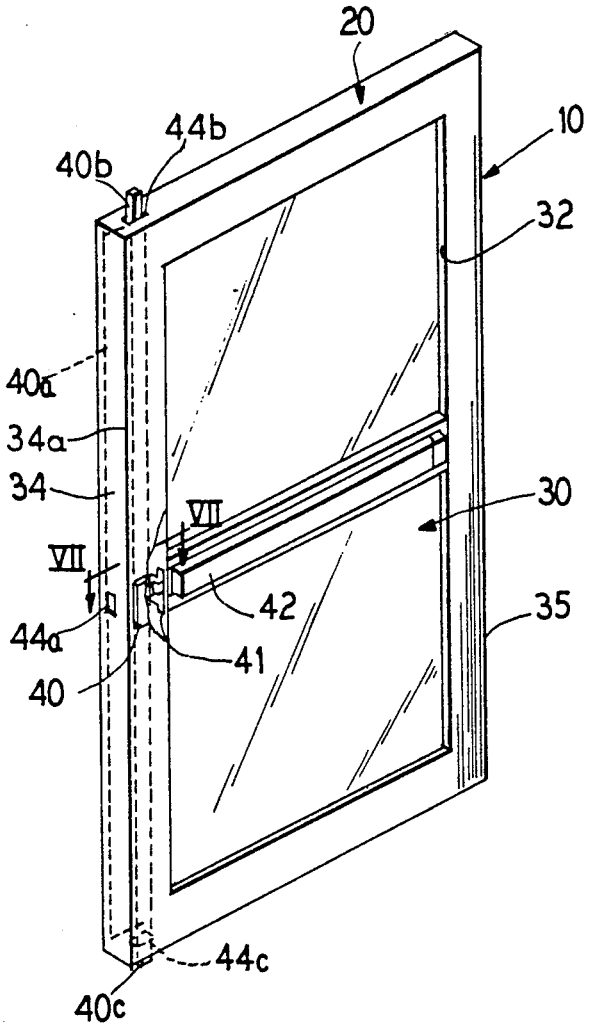
FIG. 6
FIG 7
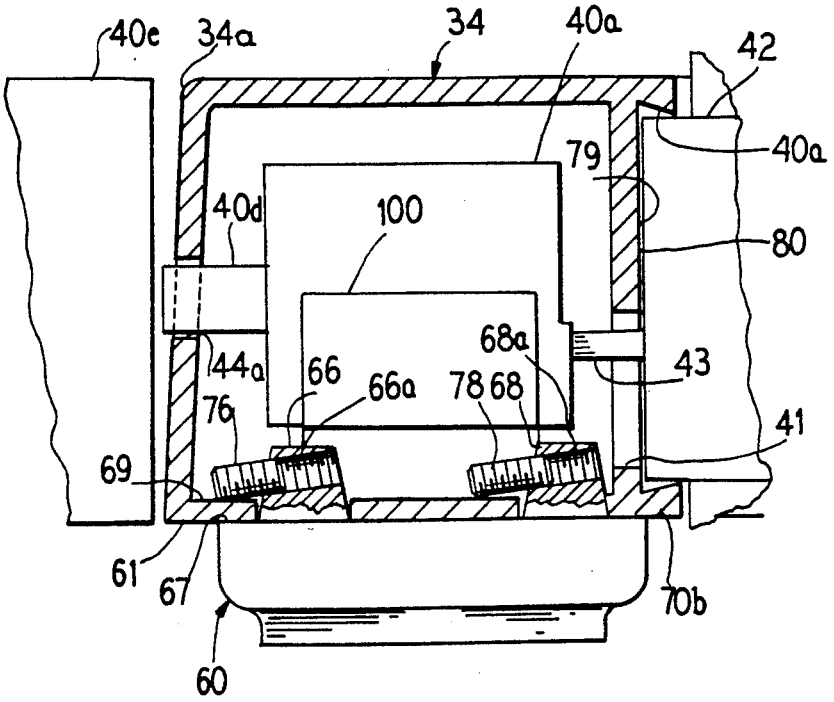

LOCK MOUNTING PAD

BACKGROUND OF THE INVENTION

This invention relates to a structure for mounting a locking mechanism to a door. In particular, the invention relates to the structure for locking a mounting pad to a door stile the locking pad holding a lock cylinder therein, the lock cylinder activating appropriate latching mechanicals located within a door stile.

Known to the art are locking pads, which hold a lock cylinder, which are attached to the door stile by two screws which penetrate a thickness of the door stile from a direction opposite the mounting pad, the screws engaging the mounting pad at appropriate threaded connections on the mounting pad inside the door stile. The screws, when rotated, draw the mounting pad up against the door. By using this method, the screw heads of the two screws are visible from an opposite side of the door from the locking pad. A disadvantage in the prior art application is that the screw heads are accessible to unauthorized persons, who can remove the mounting pad and/or tamper with it.

The present invention alleviates these problems by locating the mounting screws in an orientation which is neither visible nor accessible once the mounting pad and additional door structures are installed.

SUMMARY OF THE INVENTION

The present invention relates to a structure and method for installing a lock mounting pad to a door wherein the mounting fasteners are neither visible nor accessible once the door is assembled. The lock mounting pad structure can be utilized in a variety of types of doors, including hollow frame doors, wooden doors, doors with glass interiors, or solid doors, or any door of appropriate construction.

It is an object of the present invention to provide:

a mounting pad for holding a lock cylinder therein, easily assembled, and having a sturdy construction;

a mounting pad assembly having a minimum of parts to simplify assembly;

a mounting pad assembly requiring minimum machining or forming of the door or door stile for accepting the mounting pad;

a mounting pad that once installed, eliminates visible fasteners which hold the mounting pad to the door;

a mounting pad which prevents tampering with the locking mechanism;

a mounting pad which reduces the precision requirement of the prior art for aligning parts such as the lock activating mechanism or cam of the lock cylinder with the locking mechanicals of the door, and the attachment screws with threaded mounting pad screw holes; and a locking mechanism including the lock cylinder, the mounting pad, and fasteners which can be preassembled remote from the door and quickly and efficiently installed to the door, saving installation and maintenance time when installing, repairing, or changing out the locks for security reasons.

The objects are inventively achieved in that a locking mechanism is provided which:

provides a sturdy mounting pad having a plurality of rugged bosses which receive set screws to engage the mounting pad to the door, and a lock collar to mount the lock cylinder therein;

provides a flange and lock ring arrangement to install the lock cylinder inside the mounting pad;

provides that the set screws are located interior of the door and accessed by a tool which penetrates the door to activate the set screws to engage an inside surface of the door, the set screws thereafter being not visible or accessible from positions exterior to the door;

provides a set screw arrangement which engages a surface, rather than a set screw arrangement which engages threaded holes, thus eliminating a degree of precision in mounting the mounting pad to the door while simultaneously engaging the lock cylinder cam to particular locking mechanicals in the door, eliminating the requirement that the screws be manually aligned, through a thickness of the door, to mate with corresponding screw holes;

provides a method of installing a lock mounting pad wherein the set screws can be accessed through openings in the door, the openings being required and designed for other purposes such as the openings required for installation of a panic exist device or panic bar, thus by utilizing such openings machining of the door is reduced as, separate designated access openings for the set screws would be eliminated;

provides a method of installing a locking mechanism wherein tampering of the locking mechanism is reduced because the set screws for mounting the lock mounting pad are not accessible, the opening used for activating the set screws being covered by an internal panel or structure of the door or a panic exit device;

provides a locking mechanism which comprises only three assembled parts: the lock cylinder, the lock ring, and the mounting pad assembly with set screws preinstalled, the assembly being preassembled remote from the door and locking mechanism thus being changeable out quickly and efficiently.

DETAILED DESCRIPTION OF THE PREFERRED EMBODIMENTS

Figure 1:
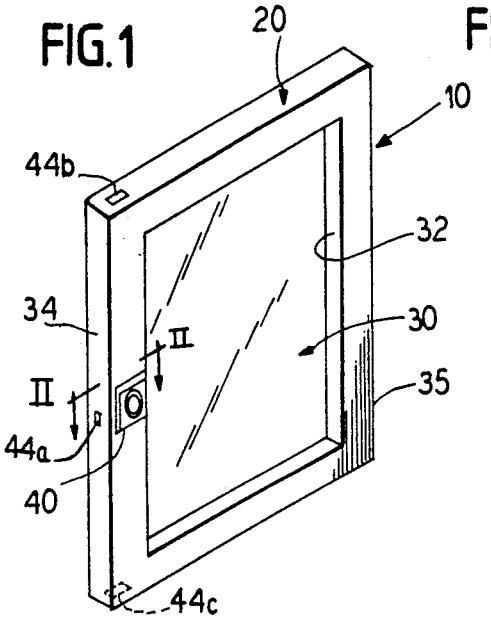
FIG. 1 is a perspective view of a door having a locking mechanism installed thereon.

FIG. 1 shows a door generally at 10 comprising a rectangular frame 20 having an interior panel 30. The frame can be of a variety of constructions, in the preferred embodiment it is a hollow type frame. The panel 30 can also be a variety of constructions, such as a glass panel having perimeter framing 32. The present invention is equally applicable to composite doors, or solid doors. All metal frame doors such as aluminum or steel, or wooden doors or any suitable material doors are encompassed by the invention.

The frame 20 comprises a door stile 34 on one side. The door stile 34 is generally located adjacent to a swinging edge 34*a* of the door opposite a hinged edge 35. The door stile 34 holds a locking mechanism 40 which can extend outwardly of the door, to lock the door to a door frame through various openings depending on the locking mechanicals. A side opening 44*a* is shown wherein a latch 40*d*, shown in FIG. 7 could protrude outwardly to engage a doorway frame 40*e*, shown in FIG. 7. An alternate location for an opening is a top opening 44*b* wherein the locking mechanism 40 would communicate with a dead bolt type mechanism 40*b* shown in FIG. 6 to extend a top dead bolt outwardly of top opening 44*b* to engage the doorway frame. A bottom opening 44*c* is shown dashed and could, similarly to top opening 44*b*, be used in conjunction with a bottom dead bolt 40*c* shown in FIG. 6 to engage the doorway frame. All three openings 44*a*, 44*b*, 44*c* could be used alone or in select combination with each other.

Figure 4:
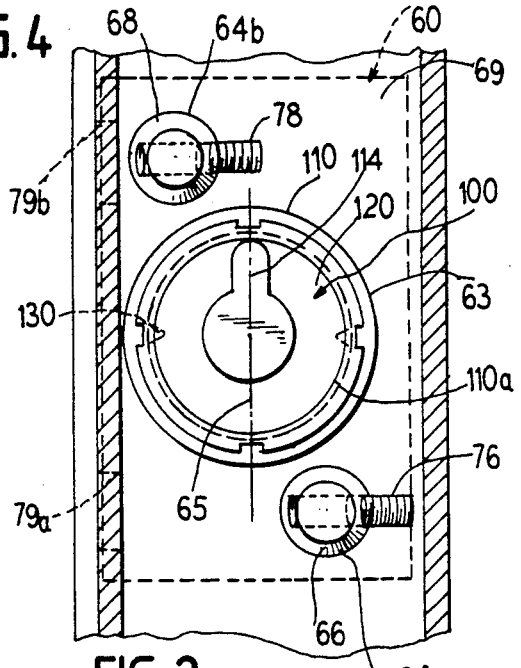
FIG. 4 is a partial sectional view, viewed generally along line IV—IV of FIG. 3.
Figure 2:
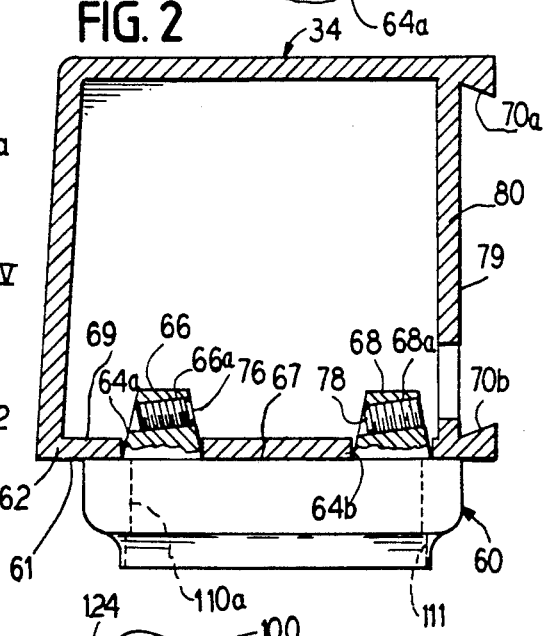
FIG. 2 is a fragmentary sectional view, viewed generally along line II—II of FIG. 1, showing the locking assembly fit up to the door but not yet engaged.

FIG. 2 shows a mounting pad 60 pressed flush against a receiving surface 61 of a receiving wall 62 of the door stile 34. The receiving surface 61 could be oriented on either side of the door 10, interior or exterior, depending on the purpose of the application. Normally, the receiving surface 61 is on an exterior side of the door 10 for the purpose of locking the door from outside of a dwelling to prevent subsequent entrance by unauthorized persons. The receiving wall 62 of the door stile 34 has a plurality of openings therein to receive the mounting pad 60. A circular lock hole 63 is shown in FIG. 4 and will be described below. A first boss opening 64*a* and a second boss opening 64*b* are arranged above and below the lock hole 63, and are offset on either side of a vertical centerline 65 of the lock hole 63 (shown in FIG. 4).

The mounting pad has formed thereon anchor portions such as a first boss 66 and a second boss 68. The two bosses 66, 68 protrude from a back side 67 of the mounting pad 60. The bosses 66, 68 are of a slightly tapered cylindrical shape, first boss 66 having a first bore 66*a* therethrough with an axis inclined to an engagement surface 69 of the door stile 34, second boss 68 having a second bore 68*a* having an axis also inclined to the engagement surface 69 of the door stile 34. The door stile 34 is shown having framing lips 70*a*, 70*b* for holding structure such as the perimeter framing 32 which holds the inside panel 30.

The mounting pad 60 as shown in FIG. 2 is shown without a lock cylinder 100 (shown and described with regards to FIG. 5) installed, or an inside lock collar 110 (also shown and described with regards to FIG. 5), for clarity. Normally the lock cylinder would be installed into the mounting pad 60 before the mounting pad 60 is mounted to the door 10.

Figure 3:
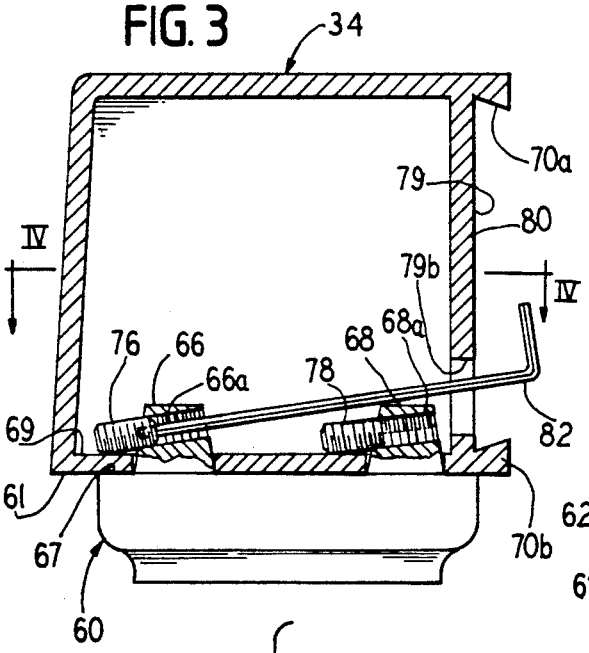
FIG. 3 is a fragmentary sectional view also viewed generally along line II—II of FIG. 1, showing the locking mechanism engaged to the door including a tool inserted for engagement.

FIG. 3 shows how the mounting pad 60 is secured to the door stile 34. The first boss 66 holds a first set screw 76 threadingly inside the first bore 66*a*. THe second boss 68 holds a second set screw 78 threadingly inside second bore 68*a*. Both the first bore 66*a* and the second bore 68*a* are inclined away from the engagement surface 69 toward a stile panel surface 79 provided on a stile interior side wall 80. A first tool access hole 79*a* provides a passage through stile panel surface 79 to communicate with the first set screw 76. A second tool access hole 79*b* shown in FIG. 3 and FIG. 4, aligned coaxially with the second set screw 78, provides a second passage through the stile panel surface 79. An engagement tool 82, in the preferred embodiment an Allen wrench, is designed to engage the set screws 76, 78 to impart rotation to the set screws. The engagement tool 82 communicates to the set screws 76, 78 through the tool access openings 79*a*, 79*b*. Alternatively, the tool access holes 79*a*, 79*b* can be a single opening 41 or a plurality of openings which are utilized for other purposes such as mounting a panic exit device 42, particularly to communicate an operating lever 43 of a panic exit device into the door stile to engage a door latching mechanism 40*a*, shown in FIG. 6, 7. Such a single opening or lever opening 41, is disclosed in FIG. 1 of U.S. Pat. No. 4,839,988 comprising a generally rectangular composite shape. Therefore, it is a novel feature of this invention that machining of the door stile, such as cutting additional tool access holes into the door stile, is eliminated. A door latching mechanism residing inside a door stile and a panic exit device with a lever communicating through a lever opening in the door stile to the latching mechanism is also disclosed in U.S. Pat. No. 4,839,988.

It is readily apparent in FIG. 3 that using the engagement tool 82 to progress the set screws 76, 78 through the bores 66*a*, 68*a* will cause the set screws 76, 78 to engage the engagement surface 69. Thus, the set screws 76, 78 and their corresponding bosses 66, 68 create a clamping mechanism, which captures the receiving wall 62 between the set screws 76, 78 and the backside 67 of the mounting pad 60. Once the engagement tool 82 is removed from the door stile 34 through the tool access holes 79*a*, 79*b* the tool access holes 79*a*, 79*b* can be covered with caps, or preferably covered with remaining door structure such as the inside panel 30 with or without the perimeter framing 32, or a panic exit device 42 shown in FIG. 7 such as disclosed in Betts and Toledo U.S. Pat. No. 4,839,988.

FIG. 4 shows the mounting pad installed. The set screws 76, 78 are progressed, protruding outward of the bosses 66, 68 and engaging the engagement surface 69 of the door stile 34. The lock cylinder 100 is shown in end elevation view, projecting through a channel 110*a* formed in the lock collar 110. The lock collar 110 is an annular structure formed from the back side 67 of the mounting pad 60 and projecting through the lock hole 63 inside the door stile 34. The lock collar 110 serves to hold and guide the lock cylinder 100. The lock cylinder 100 can be a commercially available cylinder such as manufactured by Yale or Sargent. The lock cylinder 100 has a locking cam 114 which receives rotational instruction from a key (not shown) inserted into the lock cylinder 100 from exterior of the door. Turning the key causes the cam 114 to rotate about the axis of the lock cylinder 100 which in turn communicates mechanical instruction to the particular locking, mechanicals utilized interior of the door 10 or door stile 34.

FIG. 4 shows that the bosses 66, 68 are located above and below the lock hole 63 and straddle the vertical centerline 65 of the lock hole 63. By being so situated the set screws 76, 78 reduce a rocking play of the mounting pad 60, especially if the mounting pad was subject to a prying force such as from a screwdriver handled by a burglar, which could possibly occur if the set screws 76, 78 engaged the engagement surface 69 both along the vertical centerline. By straddling the vertical centerline, the tendency of a narrow plate to rock or pivot about its vertical axis is reduced. Additionally, by straddling the vertical centerline, the lock collar 110 and the two bosses 66, 67 can be more compactly located, permitting a shorter length of the mounting pad 60.

Figure 5:
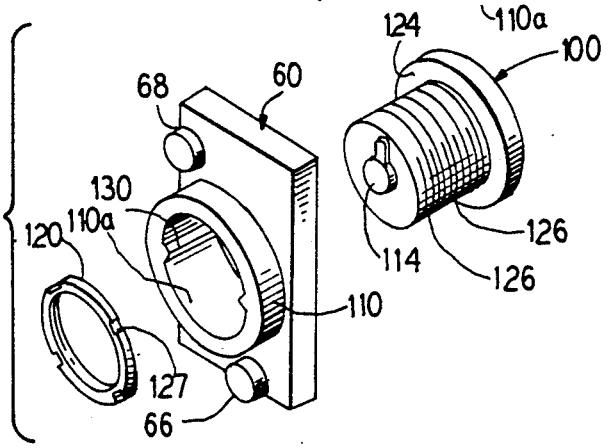
FIG. 5 is an exploded perspective view of the locking mechanism.

FIG. 5 shows the components which comprise the locking mechanism. The locking cylinder 100, the mounting pad 60 and a lock ring 120. The mounting pad 60 is formed of one piece including the bosses 66, 68 and the lock collar 110. The lock cylinder 100 comprises an outer flange 124 which abuts an outside portion 111 of the mounting pad 60 to halt insertion of the lock cylinder 100 through the channel 110*a* once the lock cylinder is fully inserted. The outside portion 111 can be a recessed annular ledge as shown dashed in FIG. 2. The locking cam 114 is also shown.

The lock cylinder 100 comprises a barrel portion 126 having external threads thereon. When the lock cylinder 100 is inserted into the channel 110*a*, some of the external threads 126*a* protrude inwardly of the look collar 110. The lock ring 120 can be screwed onto the barrel 126 until the lock cylinder 100 is drawn tightly to the mounting pad 60, the lock ring 120 abutting the lock collar 110 and the flange 124 abutting the outside portions of the mounting pad 60. The lock ring 120 can be of a type which is screwed on using a spanner wrench which engages indented portions 127 around the periphery of the ring 120. The lock collar 110 can be provided with keys 130 which ca engage indented portions of the barrel portion 126 (*see FIG. 4) to prevent rotation of the lock cylinder 100 with respect to the mounting pad 60, once installed.

Although the preferred embodiment described in the drawings illustrates a hollow stile type door, the present invention could be utilized in a solid door provided that sufficient volumes are hollowed out, such as by boring with a drill. It can be readily observed that a lock hole 63 could be bored from the receiving surface 61 of the door inwardly to communicate the lock collar 110 and locking cylinder 100 inwardly therethrough, and also boss holes 64*a*, 64*b* could be bored from the receiving surface 61 inwardly to receive the first and second bosses 66, 68. Tool access openings 79*a*, 79*b* could be bored laterally from the style panel surface 79 inwardly to accommodate the engagement tool 82 and also the progression travel of the set screws protruding exterior of the bosses 66, 68. The set screws 76, 78 in this embodiment would progress exterior of the bosses 66, 68 and press against an engagement surface 69 of the resulting bored out volumes. Of course, other volumes inside the solid stile would necessarily be hollowed out to receive the particular locking mechanical (not shown) which are activated by the lock cylinder 100.

Although other modifications and changes may be suggested by those skilled in the art, it is the intention of the inventor to embody within the patent warranted hereon all changes and modifications as reasonably and properly come within the scope of his contribution to the art.

I claim as my invention:

1. A locking system for use with a door having a door stile with a wall defining an exterior surface and an interior surface planarly parallel to said exterior surface with at least one aperture extending through said wall, and a passage through a lateral face of said door stile, said lateral face being perpendicular to said exterior surface, comprising:

a mounting pad comprising a body having at least one anchor portion projecting therefrom and extending through said aperture;

at least one rotational member carried by said anchor portion and having a portion engageable with said interior surface upon rotation of said member, to clamp said body against said wall, said member rotated by insertion of a tool into said passage.

2. A locking system according to claim 1, wherein said door provides a removable portion adjacent to the door stile and said passage is located so as to be covered by said removable portion.

3. A locking system according to claim 1, wherein said rotational member is axially movable.

4. A locking system according to claim 1, wherein said locking system further comprises a lock member mounted to said mounting pad and a latch member communicating to an external framework, said lock member communicating external latching instructions to said latch member.

5. A locking arrangement comprising:

a door, said door providing a first exterior surface with an opening thereon communicating to interior portions of the door, and a second exterior surface perpendicular to said first exterior surface, said second exterior surface providing at least one lateral passage;

a mounting pad comprising a body having at least one anchor portion formed thereon, said mounting pad mounted to said door with a portion of said body abutting said exterior surface of said door, and said anchor portion projecting interior of said door through said opening, said anchor portion providing therein at least one threaded bore;

at least one set screw, one said set screw residing in each said bore, each said set screw progressible by axial rotation through said threaded bore, outwardly of said anchor portion, causing said set screw to engage said interior portions of said door, clamping said body to said door, each said set screw aligned to be progressed by a tool inserted through said at least one lateral passage.

6. A locking arrangement as claimed in claim 5, wherein said door comprises a free edge adjacent to said exterior surface, and said mounting pad is mounted to said exterior surface adjacent to said free edge and said second exterior surface is located at a side of said mounting pad remote from said free edge, said mounting pad located between said free edge and said second exterior surface.

7. A locking arrangement as claimed in claim 5, wherein said locking arrangement further comprises a lock cylinder, receiving locking communication from exterior of said door and communicating mechanical latching instructions to an exterior structure adjacent to said door; and said mounting pad provides an aperture through said body, receiving said lock cylinder fixably mounted therein.

8. A locking arrangement as claimed in claim 7 wherein said door stile provides a hole communicating with said aperture, said lock cylinder extending into said door through said hole and said at least one anchor portion comprises two anchor portions, said anchor portions straddle a vertical centerline of said hole and said anchor portions straddle a horizontal center line of said hole.

9. A locking arrangement as claimed in claim 7, wherein said lock cylinder comprises a barrel portion with external threads thereon, and a flange portion at an outward end of said lock cylinder; and said locking arrangement further comprises a lock ring having internal threads which engage said external threads of said barrel portion, said lock cylinder resides interior of said aperture in said mounting pad with said flange portion abutting outer portions of said mounting pad, a distal end of said barrel portion protruding through said mounting pad, and said lock ring threadingly engaging said distal end of said barrel portion and, when progressed toward said mounting pad, drawing said lock cylinder tightly into said mounting pad, said lock ring tightly abutting said mounting pad when fully progressed on said external threads of said barrel portion

10. A locking arrangement as claimed in claim 9, wherein said mounting pad further comprises a lock collar portion formed thereon having an axial channel aligned with said aperture, said lock collar portion formed on said body, said lock collar portion receiving said barrel portion of said lock cylinder within said axial channel, said lock collar portion abutting said lock ring when said lock cylinder is installed; and said door stile provides a hole, said lock collar portion extending interior of said door stile through said hole.

11. A locking arrangement as claimed in claim 10, wherein said locking arrangement further comprises:

a latch; and mechanical means for selectively protruding said latch exterior of said door, said latch engaging said exterior structure to lock said door, said mechanical means receiving mechanical communication from said lock cylinder, said mechanical means residing inside said door stile.

12. A locking arrangement comprising:

a door comprising a substantially rectangular frame, said frame providing a door stile adjacent to an opening edge of said door, said door providing an exterior surface, said exterior surface comprising a face of said door stile, with an opening thereon communicating to interior portions of the door;

a mounting pad comprising a body having at least one anchor portion formed thereon, said mounting pad mounted to said door with a portion of said body abutting said exterior surface of said door, and said anchor portion projecting interior of said door through said opening, said anchor portion providing therein at least one threaded bore;

at least one set screw, one said set screw residing in each said bore, each said set screw progressible by axial rotation through said threaded bore, outwardly of said anchor portion, causing said set screw to engage said interior portions of said door, clamping said mounting pad to said door, wherein said door provides at least one passage for engaging said set screw with a tool for axial rotation of said set screw, said at least one passage proceeding through said door stile from a side of said door stile opposite said opening edge.

13. A locking arrangement as claimed in claim 12, wherein said door stile comprises a substantially hollow member having a front wall, and said front wall provides:

an inside surface, said face of said door stile, and said opening, said inside surface being planarly parallel to said face;

said anchor portion protruding through said opening in said front wall interior of said door stile, and said set screw progresses outwardly of said anchor portion to engage said interior portions comprising said inside surface of said front wall, to hold said mounting pad to said door stile in a clamping fashion.

14. A locking arrangement as claimed in claim 13, wherein said threaded bore in said anchor portion has an axis inclined to said inside surface of said front wall of said door stile progression of said set screw through said threaded bore causes said set screw to approach and thereafter abut said inside surface of said front wall of said door stile, holding said mounting pad to said door stile in a clamping fashion.

15. A locking arrangement as claimed in claim 13, wherein said at least one anchor portion comprises two anchor portions vertically spaced apart.

16. A locking arrangement as claimed in claim 15, wherein each said anchor portion comprise a circular cross section.

17. A locking arrangement as claimed in claim 15, wherein said anchor portions are located laterally offset, straddling a vertical line between said anchor portions.

18. A method of mounting a locking mechanism to a door comprising the following steps:

provide a door having a mounting face;

provide a mounting pad;

provide on said mounting pad at least one anchor portion, said anchor portion providing a threaded bore;

provide on said mounting face an opening to communicate said anchor portion interior of said door;

provide at least one set screw, one said set screw threadingly residing inside each said bore;

provide at least one passage in said door for communicating with each said bore interior of said door, for inserting a tool to engage and axially rotate each said set screw, said passage through a surface of said door which is laterally arranged to said mounting face;

provide interior portions of said door which are engaged by each said set screw when each said set screw is progressed outwardly of each said threaded bore;

install each said set screw interior of each said threaded bore;

abut said mounting pad to said mounting face of said door, protruding said anchor portion interior of said door through said opening;

insert said tool through said passage and engage each said set screw;

rotate said tool to progress each said set screw in turn, to engage said interior portions, clamping said mounting pad to said door.

19. A method according to claim 18, wherein said interior portions comprise flat surfaces and each said threaded bore is inclined to said flat surfaces, said flat surfaces engaged by each said set screw as said mounting pad is drawn tight against said mounting face.

20. A method according to claim 18, wherein said method further comprises the following steps:

provide a lock cylinder having a keyhole for mechanical communication from exterior of said door having a flange formed on an outer end, and a barrel portion having external threads; and provide a lock ring with an internal thread engagable to said external threads;

provide on said mounting pad a channel therethrough;

mount said lock cylinder to said mounting pad, by inserting through said channel and screwing said lock ring onto threads of said threaded barrel portion which protrude past said mounting pad;

progress said lock ring onto said threaded barrel portion until said flange abuts outer portions of said mounting pad and said locking ring abuts an interior surface of said mounting pad, tightly capturing said mounting pad between said flange and said locking ring.

21. A method of mounting a locking mechanism to a door comprising the following steps:

provide a door with a hollow door stile, having a mounting face on a front wall of said door stile;

provide a mounting pad;

provide on said mounting pad at least one anchor portion, said anchor portion providing a threaded bore;

provide on said mounting face an opening through the front wall of said door stile to communicate said anchor portion interior of said door;

provide at least one set screw, one said set screw threadingly residing inside each said bore;

provide at least one passage in said door for communicating with each said bore interior of said door, said passage comprising at least one access opening on an interior side wall of said door stile opposite an opening edge of said door, said passage for inserting a tool to engage and axially rotate each said set screw;

provide interior portions of said door which are engaged by each said set screw when each said set screw is progressed outwardly of each said threaded bore;

install each said set screw interior of each said threaded bore;

abut said mounting pad to said mounting face of said door, protruding said anchor portion interior of said door through said opening;

insert said tool through said passage and engage each said set screw;

rotate said tool to progress each said set screw in turn, to engage said interior portions, said interior portions comprising flat surfaces and each said threaded bore is inclined to said flat surfaces, said flat surfaces engaged by each said set screw as said mounting pad is drawn tight against said mounting face.

22. A method according to claim 21, wherein said method further provides a manual door opening mechanism; and said at least one access opening comprises a lever opening for extending an operating lever of said manual door opening mechanism interior of said door stile, and after each said set screw is fully progressed using said tool inserted into said lever opening, install said door opening mechanism covering said lever opening.

23. A method according to claim 21, wherein said method further provides said door with an interior panel, and after each said set screw is fully progressed, fixedly mounting said mounting pad to said door stile, mount said interior panel of said door adjacent to said interior side wall, covering said at least one access opening.

* * * * *